United States Patent [19]

Heintz

[11] 4,133,250

[45] Jan. 9, 1979

[54] COMBINED FEEDBACK CONTROL SYSTEM

[75] Inventor: Richard P. Heintz, Kalamazoo, Mich.

[73] Assignee: Pneumo Corporation, Boston, Mass.

[21] Appl. No.: 808,877

[22] Filed: Jun. 22, 1977

[51] Int. Cl.[2] ..... F15B 9/03; F15B 9/09; F15B 13/16

[52] U.S. Cl. ..... 91/363 A; 91/364; 91/365; 91/367

[58] Field of Search ..... 91/364, 365, 361, 363 A, 91/384, 363 R

[56] References Cited

U.S. PATENT DOCUMENTS

| | | | |
|---|---|---|---|
| 2,964,059 | 12/1960 | Geyer | 91/363 R |
| 3,270,623 | 9/1966 | Gornyost et al. | 91/411 R |
| 3,390,612 | 7/1968 | Wills | 91/364 |
| 3,390,613 | 7/1968 | Westbury et al. | 91/363 R |
| 3,410,177 | 11/1968 | Roess et al. | 91/364 |
| 3,487,750 | 1/1970 | Borgeson | 91/363 R |
| 3,540,350 | 11/1970 | Heine | 91/363 A |

*Primary Examiner*—Paul E. Maslousky
*Attorney, Agent, or Firm*—Maky, Renner, Otto & Boisselle

[57] ABSTRACT

A combined feedback control system for a servo actuator including a ram that produces a mechanical displacement output of the system as directed by a position command signal. In the combined feedback control system a lever arrangement mechanically combines displacement and velocity information of the ram, and such combined information is conveniently transduced and electrically combined with the position command signal to develop an error signal that controls an electro-hydraulic valve. The latter preferably through a fluid amplification stage controls the delivery of fluid to the ram and, thus, the position thereof. Through the lever arrangement a mechanical failure control is operative to move the ram to a predetermined position upon failure of the electro-hydraulic valve and a manual control is operable to control the ram position via the fluid amplification stage.

19 Claims, 3 Drawing Figures

COMBINED FEEDBACK CONTROL SYSTEM

BACKGROUND OF THE INVENTION

The present invention relates to a combined feedback control system for hydraulically powered position control servos and, more particularly, to a system in which one or more electro-hydraulic valves may be commanded by an externally generated electrical signal and wherein electric feedback signals are generated to control the output position.

In some instances, it is desirable to provide in a hydraulically powered position control servo an additional stage of power amplification within the servo. To effect such power amplification, the fluid flow from the electro-hydraulic valve (hereinafter referred to as EHV) is used to move or operate a main control valve. The main control valve, then, governs the fluid connections and, thus, the fluid flow to the main ram to control extension and retraction thereof. The main ram may be coupled via a mechanical connection device to an external member to effect position control of the latter as the ram position or displacement from a reference location is changed.

One conventional servo control technique requires two position feedback transducers for such power amplified servo system in order to obtain a stable control system. One of those transducers is coupled to produce a first output signal indicative of the position of the main ram, and the other transducer is coupled to produce a second transducer signal indicative of the position of the main control valve, with such latter position, as is well known, being proportional to the velocity of the main ram. A relatively complex control circuit employs those two transducer signals in separate respective feedback loops to develop a servo control signal which operates the EHV.

Typical electrical feedback loops for fluid servo devices are shown in U.S. Pat. Nos. 2,964,059 and 3,390,613, and mechanical feedback arrangements for fluid devices are shown in U.S. Pat. Nos. 3,270,623, 3,487,750 and 3,540,350. In the 3,540,350 patent, transducers are employed to monitor the operability of certain system portions but are not employed as feedback signal generating devices. Also in the 3,540,350 patent, the main servo valve plunger, which delivers fluid to a ram, is controllably driven by a lever, which is coupled to respond to the electro-hydraulic valve mechanism and to feedback information indicative of the actual ram position. Similarly, in the 3,487,750 and the 3,270,623 patents a lever coupled to the ram delivers mechanical feedback information to a fluid amplifier of an electro-hydraulic valve. In the device of the 3,390,613 patent a lever delivers mechanical feedback information directly to the fluid amplifier at the input of the electro-hydraulic valve and also produces electrical feedback information indicative of the main ram displacement for electrical control of the electro-hydraulic valve.

In the above-mentioned representative prior art patents, the feedback information only represents the ram position and does not relate to the instantaneous ram velocity, which may be an important consideration especially when high inertia loads are encountered. Moreover, in the past conventional control circuitry, which employed plural transducers, such as respective liner variable differential transformers (LVDT) that did consider both displacement and velocity information, the plural feedback channels and relatively complex electronic circuitry required to analyze the feedback and input information were relatively expensive, and with increased complexity found to be less reliable.

SUMMARY OF THE INVENTION

In the hydraulically powered position control servo system in accordance with the present invention, the advantages of electro-hydraulic control and mechanical feedback are combined. A single mechanical feedback lever mechanism combines feedback information indicative of both the output ram displacement and the main control valve displacement, with the latter being indicative of the ram velocity. Such combined mechanical feedback information is detected by a single transducer, such as an LVDT, to control an EHV, which in turn effects any necessary adjustment of the main control valve. More particularly, the transducer signal is off-set against a position command signal to develop a control signal which operates the EHV.

Thus, with only one feedback position transducer being required per servo actuation channel and the relatively simplified circuitry required therefor, the position and velocity monitoring and control functions, which previously required two such transducers and associated complex circuitry, still are achieved with a relative increase in the efficiency and reliability of the system and a decrease in the cost thereof. These advantages are, moreover, particularly important in those instances where a multiplicity of servo channels and/or transducers are employed in the servo system to control a single ram position in a manner that effects continuous control thereof even after a failure of one of its components.

In accordance with another aspect of the invention, a resilient biasing mechanism coupled to the feedback lever arrangement operates the latter in the event of a passive failure of the electro-hydraulic valve. Such biasing device assures that the ram will return to a preselected position and maintains the ram in that position.

The servo actuator system in accordance with the invention is readily adaptable to several modes of manual control, for example in response to manually derived or controlled electrical position command signals or straightforward manually produced mechanical input force that overrides the above-mentioned resilient bias mechanism and/or the electro-hydraulic valve. Thus, in the event of a failure of the servo system, several manual overrides may be provided.

With the foregoing in mind, a principal object of the invention is to provide a combined feedback arrangement for a servo system.

Another object is to provide a servo system that is improved in the noted respects.

An additional object is to combine position and velocity information in a servo system and to utilize that combined information in electrical form to operate such system via an EHV.

A further object is to reduce the number of position feedback transducers required to obtain a stable control servo system and, thereby, to reduce the cost, to increase the efficiency and reliability, and to facilitate the adding of redundancy features for such servo systems.

Still another object is to return the ram of a servo system to a preselected position upon passive failure of the electrical input valving mechanism thereof.

Still an additional object is to facilitate manual control and/or manual override of a servo system.

These and other objects and advantages of the present invention will become more apparent as the following description proceeds.

To the accomplishment of the foregoing and related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be employed.

DESCRIPTION OF THE PREFERRED EMBODIMENTS

Figure 1:
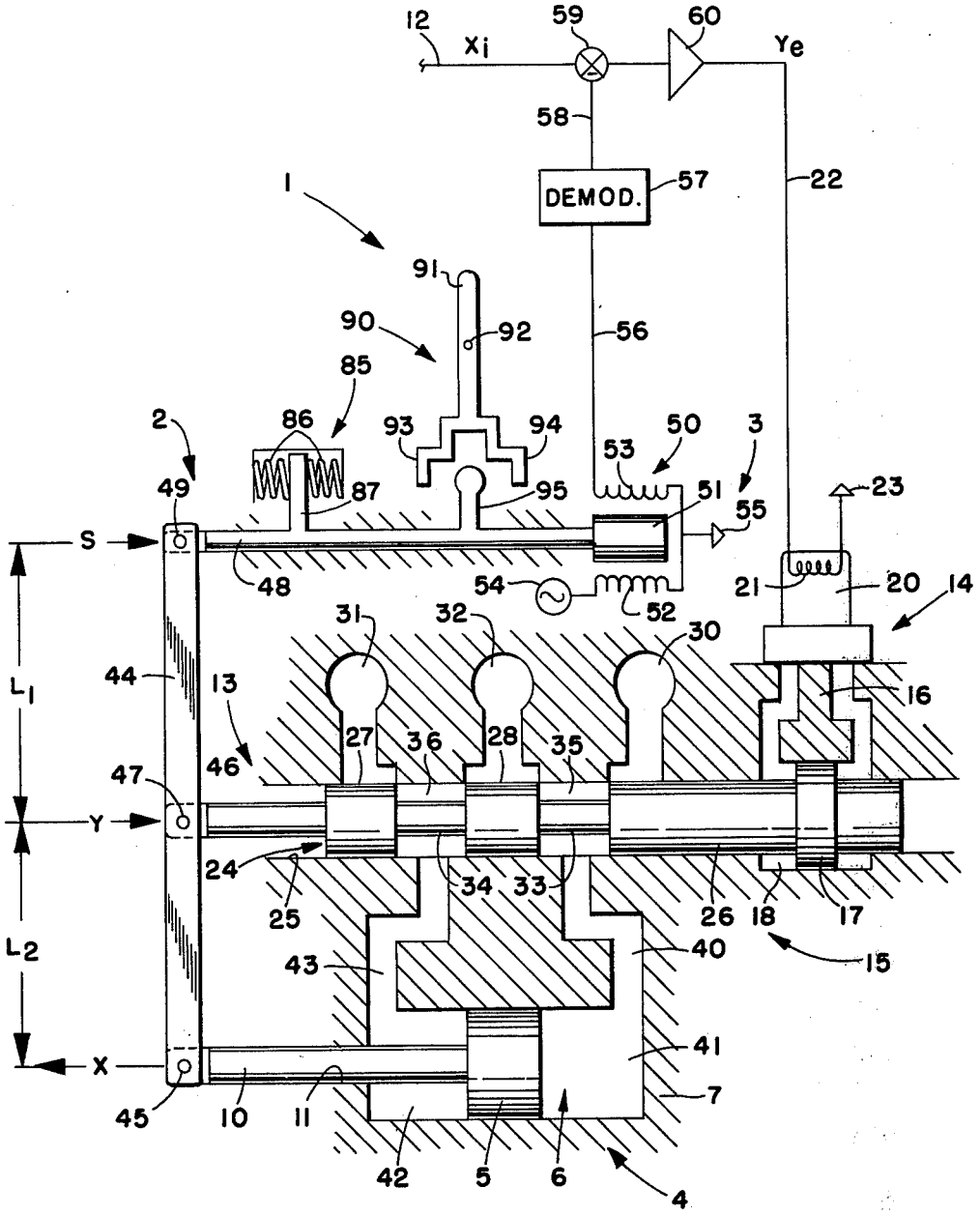
FIG. 1 is a schematic illustration, partly in block form, of a servo system employing the combined feedback control system in accordance with the invention.

Referring now to the drawings in detail, and initially to FIG. 1, a servo system is generally indicated at 1 and includes a combined feedback control system 2 in accordance with the invention that effects controlled operation of a servo actuator 3. The servo actuator 3 includes a ram assembly 4 which may be coupled to an external device to perform work on the same. More particularly, the ram assembly 4 has a main ram or piston 5 movably, i.e. preferably linearly movable, positioned within a cavity 6, which is formed in a generally fluid-tight body 7, and an output rod 10, which is coupled to the ram 5 and extends outside the body 7 through an opening 11 therein, is connectable to such external device to move the same as the ram is moved in the cavity 6. Such motion ordinarily is obtained in response to the combined feedback control system 2 and an input position command signal, preferably an electrical signal supplied to an input electrical line 12 from external equipment, as will be described further below.

The servo actuator 3 has an amplification stage in the form of a main control valve 13 which in response to fluid control by a conventional EHV 14 controls the delivery and venting of hydraulic fluid to the ram cavity 6 to move the ram 5 or hold the same in fixed position. It will be appreciated that additional amplification stages or no amplification stage may be used in accordance with the present invention. Moreover, although the invention will be described with reference to the use of hydraulic fluid, it will be appreciated that other fluids may be employed.

The main control valve 13 and EHV 14, which also may be formed and positioned in the body 7 including the respective cavities illustrated therein, may be considered the fluid input mechanism 15 that controls operation of the ram assembly 4. The EHV 14 includes a controlled fluid delivery system 16 for controlling the relative position of a control piston 17 in a cavity 18 and an electrically-responsive control portion 20 for controlling such fluid delivery system 16 in well known manner in response to a position error signal that is applied to one side of a conventional coil 21, for example, via a control line 22 of the combined feedback control system 2. The other side of the coil 21 is connected by a terminal 23 to a source of relative fixed potential, such as ground potential, as is conventional.

The main control valve 13 has a valve spool 24 movably positioned within a cavity 25 in the body 7, and such spool includes an elongate land 26 by which the spool is mechanically connected to the EHV control piston 17 for movement thereby. A portion of the elongate land 26 and further flow controlling lands 27, 28 of the spool 24 are generally aligned with respective pressure ports 30, 31, which receive a supply of pressurized hydraulic fluid from a conventional source, not shown, and return port 32, which is coupled to vent or to return fluid to such external source or reservoir therefor, as is conventional. Between the lands 26, 28 and 28, 27 are respective grooves 33, 34, which define flow chambers 35, 36.

In operation of the servo actuator 3, a position error signal on the control line 22 causes the EHV 14 to move the control piston 17 to a discrete location in the cavity 18. When the control piston 17 is centered or in a neutral position, the lands 26, 27, 28 in the main control valve 13 block the respective pressure ports 30, 31 and return port 32, and the ram 5 is held in a fixed position in the ram assembly 4. When the control piston 17 and, thus, the main control valve spool 24 are moved to the right, relative to the illustration in FIG. 1, the pressure port 30 is connected via the flow chamber 35 to deliver hydraulic fluid under pressure through a flow path 40 in the body 7 to an extend chamber 41 of the ram assembly cavity 6, and a retract chamber 42 of the cavity 6 is connected via a flow path 43 and the flow chamber 36 to the return port 32, thus to cause the ram 5 to be moved to the left, relative to the illustration in FIG. 1, to extend the output rod 10 relative to the body 7. Similarly, when the control piston 17 and spool 24 are moved to the left of the center or neutral position, hydraulic fluid from the pressure port 31 is delivered via the flow chamber 36 and the flow path 43 to the retract chamber 42, and the extend chamber 41 is connected by the flow path 40 and the flow chamber 35 to the return port 32, causing movement of the ram 5 to the right withdrawing or retracting the output rod 10 into the body 7.

The relative position or displacement of the ram 5 in the ram assembly 4 is represented by the letter X, and that of the main control valve spool 24 by the letter Y, as is schematically shown in FIG. 1. It will be appreciated that the velocity with which the ram 5 moves will be proportionally related to the displacement of the spool 24, with such latter displacement determining the flow rates of fluid capable of delivery to and return from the ram cavity 6. As will be apparent, the servo actuator 3 described above also may include various fluid sealing devices, mechanical support, alignments and guiding devices, fluid connectors, and the like, all of which are conventional and may be employed in customary manner.

In the combined feedback control system 2 a lever 44 is coupled to the output rod 10 at a connection 45, to an extension rod 46 of the spool 24 at a connection 47, and to a transducer connecting rod 48 at a connection 49 for combining the displacements X of the ram 5 and Y of the spool 24 to produce a combined displacement S which is coupled via the connecting rod 48 directly to a conventional electro-mechanical transducer 50, such as a typcial linear variable differential transformer (LVDT). More particularly, the connecting rod 48 is coupled directly to the movable core 51 of the transducer 50, which also includes primary and secondary windings 52, 53. One end of the primary winding 52 is coupled to a conventional AC power source 54, and the other end thereof is connected via a terminal 55 to a source of known potential such as relative ground potential. An AC transducer signal, which is produced in the secondary winding 53 depending on the relative position of the core 51 and the windings 52, 53, is proportionally representative of the combined displacement S. Such AC transducer signal is delivered via a transducer output line 56 to a conventional demodulator circuit 57, which converts such AC transducer signal to a preferably DC feedback signal that also is proportionally representative of the combined displacement S. The feedback signal is delivered via feedback line 58 to a summing junction 59 and is offset thereat against the input position command signal $X_i$, which is provided from external equipment on the input line 12. The thusly combined input position command signal $X_i$ and feedback signal is amplified by a conventional amplifier 60 to produce on line 22 the position error signal, referred to below as $Y_e$ since such signal represents the amount of change in displacement of the main control valve spool 24 to effect a corresponding change in the displacement of the ram 5.

Summarizing operation of the servo system 1, then, an input position command signal $X_i$ on the input line 12 is combined at the summing junction 59 with the feedback signal on line 58 to produce a position error signal $Y_e$. That position error signal $Y_e$ causes the EHV 14, for example, to move the control piston 17 and main control valve spool 24 to the left to effect retraction of the ram 5 and output rod 10 as described above. Such leftward movement of spool 24 decreases the magnitude of the combined displacement S, moving the core 51 leftward, and the retraction of the ram 5 further reduces the combined displacement moving core 51 further leftward; such core movement ultimately causes a sufficient change in the feedback signal on the feedback line 58 such that the resulting position error signal $Y_e$ will approach a value that causes the spool 24 to assume its neutral position. Ordinarily when the spool 24 is in such neutral position, the ram 5 will have achieved a position or displacement representing that called for by the input position command signal $X_i$. It will be appreciated that similar operation of the servo system 1 will occur when it is desired to extend the ram 5 and to maintain it in a fixed position as the forces applied by the external device may vary, fluid leakage may occur, etc..

A mathematical analysis of the operative servo system of FIG. 1 will now be described briefly. The transducer displacement or combined displacement S measured by the transducer 50 may be quantified, as follows:

$$S = \frac{L_1}{L_2} X + \frac{L_1 + L_2}{L_2} Y, \qquad 1$$

$$S = \frac{L_1 + L_2}{L_2}\left(\frac{L_1}{L_1 + L_2} X + Y\right); \qquad 1a$$

where X represents the actual displacement or relative position of the ram 5, Y represents the actual displacement or relative position of the valve spool 24 and is proportional to the actual ram velocity $\dot{X}$, and $L_1$ and $L_2$ are the respective distances along the combined feedback lever 44 between the respective pairs of connections 45, 47, 49, as can be seen in FIG. 1. Equation 1 can be rewritten, as follows:

$$\frac{L_2}{L_1 + L_2} S = \frac{L_1}{L_1 + L_2} X + Y, \qquad 2$$

with $L_1$ and $L_2$ and their respective ratios being considered constants.

The error displacement or position error signal $Y_e$ of the valve spool 24 or the amount that such spool preferably has to be moved to obtain a desired position thereof for a corresponding movement of the ram 5, is $$Y_e = Y_i - Y, \qquad (3)$$

where $Y_i$ represents the desired position of the valve spool 24 to obtain relatively prompt and efficient movement of the ram 5 to the position required by $X_i$, the input position command signal. Moreover, $$Y_i = (Y_m/V_m)\dot{X}_i, \qquad (4)$$

where $Y_m$ represents the maximum or rated displacement of the valve spool 24, $V_m$ represents the corresponding maximum or rated velocity of the ram 5, for example depending on friction, inertias, etc., with their ratio $Y_m/V_m$ being a proportionality constant, and $\dot{X}_i$ represents the desired velocity of the ram for a corresponding displacement of the valve spool 24. Further, $$Y_i = (Y_m/V_m)\, K_L\, X_e, \qquad (4a)$$

where $K_L$ represents the total gain of the system 1 and $X_e$ represents the error displacement of the ram 5 or the amount it has to be moved to obtain a desired position thereof. It will be seen that the desired ram velocity $\dot{X}_i$ is proportional to the error displacement of the ram and the system gain. Also, $$Y_i = (K_L\, Y_m/V_m)\,(X_i - X), \qquad (4b)$$

where $X_i$ represents the desired position of the ram, i.e. the input position command signal, so that it will be seen that the error displacement $X_e$ of Equation 4a equals the difference between the desired and the actual ram displacements.

By substituting the value of $Y_i$ from Equations 4 above into Equation 3, it will be seen that:

$$Y_e = \frac{K_L Y_m}{V_m} X_i - \frac{K_L Y_m}{V_m} X - Y. \qquad 5$$

The system gain $K_L$ and the rated values $Y_m$ and $V_m$ are constants in the system depending on the particular hardware components used. Moreover, the values of $L_1$ and $L_2$ also are relatively constant but may be discretely selected according to the locations along the combined feedback lever 44 that the connections 45, 47, 49 are made. Therefore, the ratio $L_1/L_1 + L_2$ can be made equal to that $K_L\, Y_m/V_m$. Then, substituting the latter equality to Equation 5, the following equation can be written:

$$Y_e = \frac{K_L Y_m}{V_m} X_i - \frac{L_1}{L_1 + L_2} X - Y; \qquad 6$$

and substituting from Equation 2 above, $$Y_e = \frac{K_L Y_m}{V_m} X_i - \frac{L_2}{L_1 + L_2} S. \quad 6a$$

Figure 2:
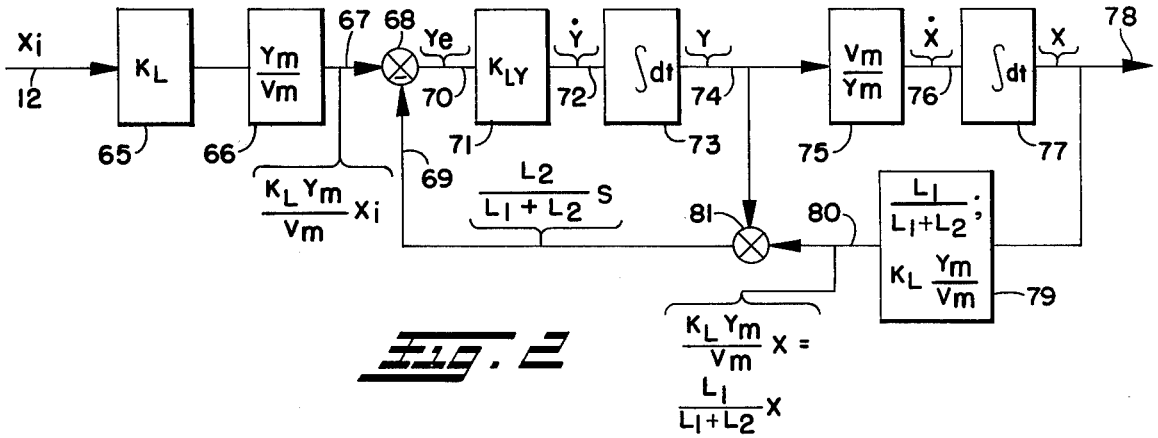
FIG. 2 is a block diagram depicting the control loop operative mechanism of the system of claim 1.

Accordingly, the single actual combined displacement S can effectively replace the two actual displacements X and Y in order to effect the desired servo control function. Thus, by relating the value S and the desired or commanded ram position or displacement $X_i$, i.e. the input position command signal, in accordance with Equation 6*a*, the error displacement of the valve spool 24 can be determined and correction of that error to obtain an efficient movement of the ram 5 to its commanded position can be effected. Such overall operation of the servo system 1 of FIG. 1 described mathematically above is illustrated in the block diagram of FIG. 2.

Turning now to such block diagram, the input position command signal $X_i$ is operated on in accordance with the total system gain $K_L$ shown in box 65 and the proportionality constant $Y_m/V_m$ shown in box 66, thus producing on line 67 at one input of the summing junction 68 the first term of Equation 6*a*. The second term of Equation 6*a* is delivered on line 69 to the summing junction 68 to be offset with the first term thereby to produce the spool position error signal $Y_e$ on line 70. Such second term is derived by operating on the position error signal $Y_e$ by the gain factor $K_{LY}$ of the EHV 14, as shown at box 71, to move the spool 24 with the velocity $\dot{Y}$, as is shown on line 72. The spool velocity $\dot{Y}$ is effectively integrated, for example by the extension rod 46 and lever 44, as shown in box 73, to derive the actual displacement Y of the valve spool 24, as shown at line 74. The value Y is operated on by the proportionality constant $V_m/Y_m$ to derive the expected velocity of $\dot{X}$ of the ram 5 in response to such displacement Y of the valve spool 24, as shown in box 75 and on line 76, and such ram velocity is integrated, for example by the output rod 10 and lever 44, as shown at box 77 to derive the actual displacement value X of the ram, which is the system output to work on the external device, as shown by the arrow 78.

The value X is operated on in effect by the ratio $L_1/L_1 + L_2$ that is equal to the system gain $K_L$ $(Y_m/V_m)$, as shown in box 79 to weight the effect of the displacement X on the combined displacement S according to the locations of the various connections to the lever 44. The thusly weighted value on line 80 and the value Y on line 74 are combined in the summing junction 81 to produce on line 69 the second term in Equation 6*a*.

Figure 3:
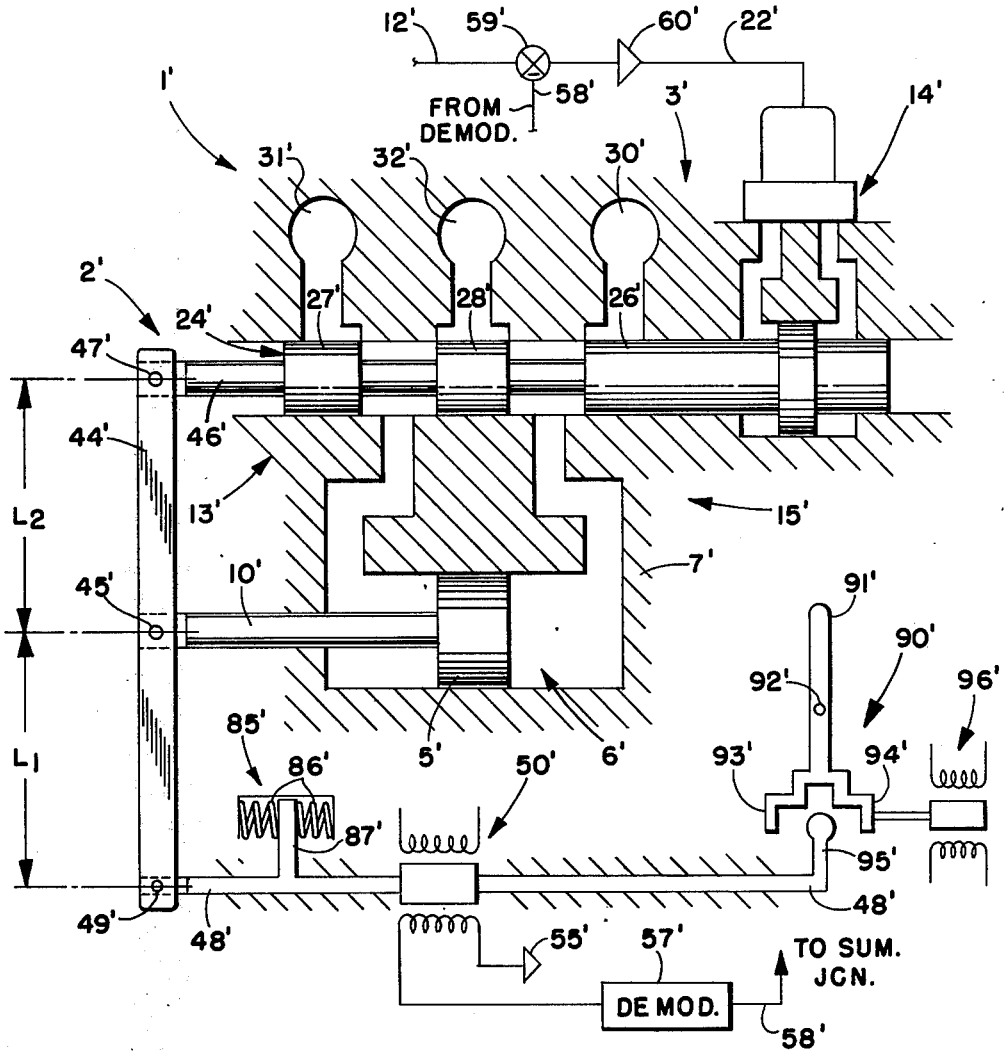
FIG. 3 is a schematic illustration of a modified servo system with a combined feedback control system in accordance with the invention.

From a qualitative point of view, then, it now should be evident that the combined displacement S represents a particular combination of the separate feedbacks used in the servo system 1. Accordingly, the above-described mathematical analysis and the description of the block diagram of FIG. 2 fully discloses in terms of control systems the analytical operation of the servo system 1 including the combined feedback control system 2 thereof. It is noted here, however, that the foregoing description and analysis assumes that the value of the term $K_L$ $(Y_m/V_m)$ is less than unity since $K_L$ $(Y_m/V_m) = L_1/L_1 + L_2 \leqq 1$. Nevertheless, if such term were greater than unity, the servo system 1 of FIG. 1 could be re-structured or modified to the form of the servo system 1', which is illustrated in FIG. 3, wherein primed reference numerals designate parts corresponding in form and function to those designated with similar unprimed reference numerals in FIG. 1. The operation of the servo system 1', including the combined feedback control system 2' and the servo actuator 3', is substantially the same as the operation of the servo system 1 described above with reference to FIG. 1. Thus, the fluid input mechanism 15' in response to the combined feedback control system 2', including the lever 44', transducer 50', demodulator 57',summing junction 59', and amplifier 60', for example, provides amplified control of the displacement of ram 5'.

Referring to both FIGS. 1 and 3, a failure control mechanism 85, 85', which includes a caged spring 86, 86' is coupled by a rigid link 87, 87' to the transducer connecting rod 48, 48'. In the event of passive failure of the electro-hydraulic valve 14, 14', the ram 5 can be returned to a preselected position as determined by the caged spring. Accordingly, upon such passive failure, the caged spring 86, for example, moves the connection 49 of the lever 44 to operate the main control valve 13, which in turn moves the ram 5 to the preselected position. Moreover, the caged spring 86 will continue to effect operation of the servo actuator 3 in a servo controlled mode even in response to changing loads on the output rod 10. Thus, the failure control 85 importantly differs from conventional systems in which a caged spring directly coupled to the main control valve was used to hold the ram at whatever position prevailed before the time of the passive failure; and such ram position would tend to drift depending on the external load thereon, there being no servo function provided.

Combined manual and electrical control for the servo systems 1, 1' in FIGS. 1 and 3, may be provided conveniently by the illustrated manual control 90, 90'. Such manual control 90, for example, includes a lever arm stick 91 that is mounted for pivotal movement about a pivot connection 92 and a pair of offset control arms 93, 94 that are mounted to abut and thereby to apply force to a rigid link 95 attached to the transducer connecting rod 48.

As is illustrated in FIG. 3, for example, the stick 91' may be mechanically coupled to a further transducer 96', such as a conventional linear variable differential transformer (LVDT), which may be used to generate the desired input position command signal $X_i$, for example as a DC voltage level, in conventional manner. The stick may be moved manually to effect electrical generation of the input position command signal while the off-set control arms 93', 94' ordinarily remain spaced apart from the rigid link 95. A similar arrangement may be employed with the stick 91 of FIG. 1. To obtain manual override of, for example, the servo system 1, the stick 91 can be pivoted manually about the pivot 92, e.g., by the operator of the equipment employing the servo system 1, with sufficient force to overcome that exerted by the caged spring 86 and the forces on the main control valve spool 24. Such manual override control will effect manual operation of the spool 24 which in turn effects movement of the ram 5.

I, therefore, particularly point out and distinctly claim as my invention:

1. A servo actuator with a combined feedback control system, comprising ram means for producing a displacement output in response to a fluid input, input means for receiving a position command signal representative of a desired displacement of said ram means, electrically operable means for controlling the delivery of fluid to said ram means and, thus, the position thereof in response to an error signal, said electrically operable means including means for producing mechanical displacement information representative of the velocity of said ram means, lever means for mechanically combining displacement of said ram means and such mechanical displacement information to produce combined information thereof, transducer mens responsive to such combined information for producing an electrical feedback signal representative of such combined information, and combining means for electrically combining such position command signal and such feedback signal to develop such error signal.

2. The system of claim 1, wherein said electrically operable means comprises an electro-hydraulic valve.

3. The system of claim 1, wherein said transducer means comprises a linear variable differential transformer.

4. The system of claim 1, wherein said combining means comprises an electrical summing junction.

5. The system of claim 1, further comprising main control valve means for fluidically amplifying a fluid output of said electrically operable means.

6. A servo actuator with a combined feedback control system, comprising ram means for producing a displacement output in response to a fluid input, input means for receiving a position command signal representative of a desired displacement of said ram means, electrically operable means for controlling the delivery of fluid to said ram means and, thus, the position thereof in response to an error signal, lever means for mechanically combining displacement and velocity information of said ram means to produce combined information thereof, transducer means for producing an electrical feedback signal representative of such combined information, combining means for electrically combining such position command signal and such feedback signal to develop such error signal, and main control valve means responsive to fluid from said electrically operable means for delivering fluid to and returning fluid from said ram means.

7. The system of claim 6, wherein said main control valve means includes a mechanical displacement parameter that is proportional to the velocity of said ram means.

8. The system of claim 7, wherein said main control valve means comprises a spool valve, and wherein said electrically operable means comprises an electro-hydraulic valve means for controlling the position of the spool of said spool valve.

9. The system of claim 7, further comprising coupling means for coupling said lever means to said ram means and said main control valve means to combine such respective mechanical displacements thereof.

10. The system of claim 9, wherein said coupling means includes means for coupling said lever means to said transducer means.

11. The system of claim 10, wherein said main control valve means comprises a spool valve having a movable spool, and wherein said coupling means includes means for connecting said spool to said lever means at a location therealong between connections of said lever means to said ram means and to said transducer means.

12. The system of claim 10, wherein said main control valve means comprises a spool valve having a movable spool, and wherein said coupling means includes means for connecting said ram means to said lever means at a location therealong between connections of said lever means to said spool and to said transducer means.

13. A servo actuator with a combined feedback control system, comprising ram means for producing a displacement output in response to a fluid input, input means for receiving a position command signal representative of a desired displacement of said ram means, electrically operable means for controlling the delivery of fluid to said ram means and, thus, the position thereof in response to an error signal, lever means for mechanically combining displacement and velocity information of said ram means to produce combined information thereof, transducer means for producing an electrical feedback signal representative of such combined information, combining means for electrically combining such position command signal and such feedback signal to develop such error signal, and main control valve means for fluidically amplifying a fluid output of said electrically operable means, said main control valve means comprising a spool valve having a spool movable in response to such fluid output from said electrically operable means, and further comprising failure control means for urging said lever means and, thus, said spool to predetermined relative positions upon failure of such electrically operable means thereby to move said ram means to and to hold the same at a predetermined displacement thereof.

14. A servo actuator with a combined feedback control system, comprising ram means for producing a displacement output in response to a fluid input, input means for receiving a position command signal representative of a desired displacement of said ram means, electrically operable means for controlling the delivery of fluid to said ram means and, thus, the position thereof in response to an error signal, lever means for mechanically combining displacement and velocity information of said ram means to produce combined information thereof, transducer means for producing an electrical feedback signal representative of such combined information, combining means for electrically combining such position command signal and such feedback signal to develop such error signal, and main control valve means for fluidically amplifying a fluid output of said electrically operable means, said main control vlave means comprising a spool valve having a spool movable in response to such fluid output from said electrically operable means, and further comprising means for manually mechanically displacing said lever means to effect movement of said spool and, thus, of said ram means to manually controlled positions of the latter.

15. A servo actuator with a combined feedback control system, comprising ram means for producing a displacement output in response to a fluid input, input means for receiving a position command signal representative of a desired displacement of said ram means, electrically operable means for controlling the delivery of fluid to said ram means and, thus, the position thereof in response to an error signal, lever means for mechanically combining displacement and velocity information of said ram means to produce combined information thereof, transducer means for producing an electrical feedback signal representative of such combined information, combining means for electrically combining such position command signal and such feedback signal to develop such error signal, and failure control means for moving said ram means to a predetermined position upon failure of said electrically operable means.

16. The system of claim 15, wherein said failure control means comprises bias means coupled to said lever means for urging the same to effect such movement of said ram means to and holding of the same at such predetermined position.

17. A servo actuator with a combined feedback control system, comprising ram means for producing a displacement output in response to a fluid input, input means for receiving a position command signal representative of a desired displacement of said ram means, electrically operable means for controlling the delivery of fluid to said ram means and, thus, the position thereof in response to an error signal, lever means for mechanically combining displacement and velocity information of said ram means to produce combined information thereof, transducer means for producing an electrical feedback signal representative of such combined information, combining means for electrically combining such position command signal and such feedback signal to develop such error signal, and means for manually controlling the displacement of said ram means.

18. The system of claim 17, wherein said means for manually controlling comprises means for producing a mechanical displacement output and transducer means for producing such position command signal representative of such mechanical displacement output.

19. The system of claim 18, wherein said means for manually controlling comprises means for mechanically moving said lever means to effect such manual control of the displacement of said ram means.

* * * * *